United States Patent [19]

Buhler

[11] Patent Number: 4,908,993

[45] Date of Patent: Mar. 20, 1990

[54] GRINDING MACHINE FOR REPROFILING RAILHEADS

[75] Inventor: Fritz Buhler, Ecublens, Switzerland

[73] Assignee: Les Fils D'Auguste Scheuchzer S.A., Switzerland

[21] Appl. No.: 265,765

[22] Filed: Nov. 1, 1988

[30] Foreign Application Priority Data

Nov. 7, 1987 [EP] European Pat. Off. ..... 87116468.7

[51] Int. Cl.[4] ..... E01B 31/17

[52] U.S. Cl. ..... 51/178; 51/165.71; 364/474.06

[58] Field of Search ..... 51/178, 165.71; 364/474.06

[56] References Cited

U.S. PATENT DOCUMENTS

| | | | |
|---|---|---|---|
| 4,115,857 | 9/1978 | Panetti | 51/178 |
| 4,584,798 | 4/1986 | Rivoire | 51/178 |
| 4,785,589 | 11/1988 | Buhler | 51/178 |
| 4,829,723 | 5/1989 | Ball et al. | 51/178 |

FOREIGN PATENT DOCUMENTS

| | | | |
|---|---|---|---|
| 0125348 | 11/1984 | European Pat. Off. | 51/178 |
| 0235602 | 9/1987 | European Pat. Off. | 51/178 |
| 2843649 | 4/1979 | Fed. Rep. of Germany | 51/178 |

*Primary Examiner*—Roscoe V. Parker

*Attorney, Agent, or Firm*—Kane, Dalsimer, Sullivan, Kurucz, Levy, Eisele and Richard

[57] ABSTRACT

The machine which comprises serveral grinding heads per stretch of rail and which may be moved with respect to height by means of lifting devices is equipped with an installation for automatically lifting grinding wheels (M1to M8) in the critical zones of switches, namely frog and blade zones.

This installation comprises, on either side of each stretch of rail (R1, R2), a pair of sensors (C1, C2, C3, C4) at the front and a pair of sensors (C'1, C'2, C'3, C'4) at the rear, detecting the starts of critical zones, therefore the widening of the running tread in the zone of a switch and/or their auxiliary parts adjacent to the rails; a computation unit connected, on the one hand, to the sensors and, on the other hand, to each lifting device and equipped with a memory containing all the data defining the lifting distances of each grinding head in the critical zones; a unit for measuring the path traveled connected to the computation unit; the computation unit is provided in order to command the lifting and the lowering of each grinding head independently, over memorized distances, as a function of signals received by the sensors.

10 Claims, 5 Drawing Sheets

Fig.9a
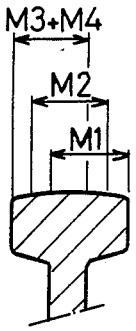
Fig.9b
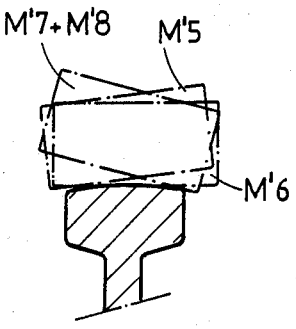
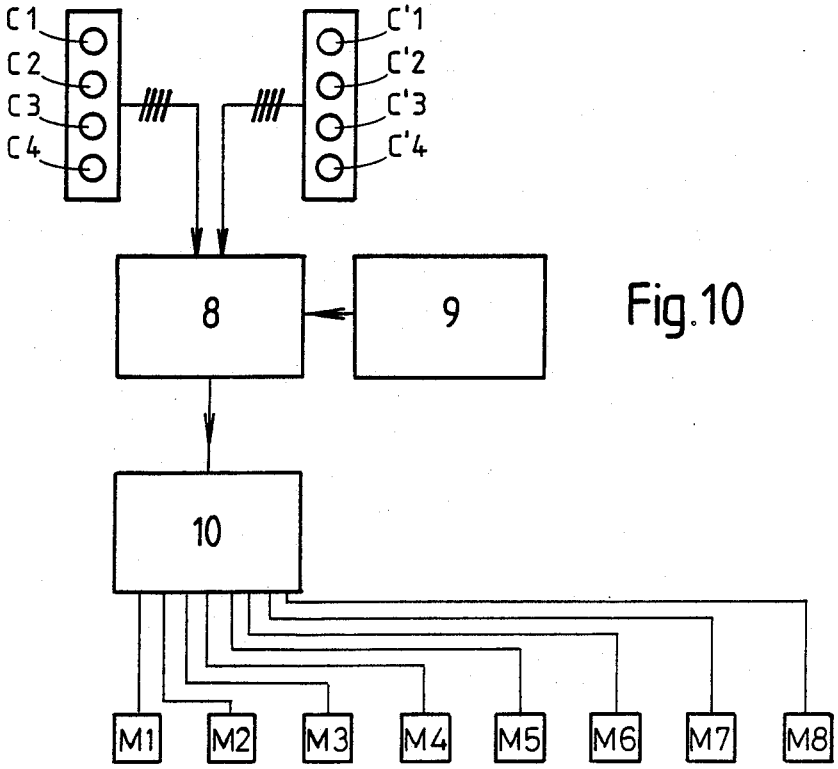
Fig.10

GRINDING MACHINE FOR REPROFILING RAILHEADS

FIELD THE INVENTION

The invention relates to a grinding machine for reprofiling railheads which is equipped with at least one grinding head per stretch of rails which may be moved with respect to height by at least one lifting device which may be commanded automatically.

PRIOR ART

A grinding machine of this type, for example such as described in German Pat. No. DE 2,843,649 of the Applicant, makes it possible to remove undulations and to reprofile the rails and is equipped with grinding wheels for completely machining the running tread as well as the radii and the outer and inner faces of the rails. This machine may be equipped with peripheral grinding wheels or cup grinding wheels.

Another machine for reprofiling the railhead, equipped with cup grinding wheels, is equipped in European Pat. No. EP 0,125,348 of the Applicant.

Finally, a vehicle for measuring and grinding the profile of a railhead, using cup grinding wheels, is known from European Pat. Application 87/101,477 of the Applicant. This vehicle operates in a manner such that each grinding head is lifted automatically from the rail it has ground if the facet obtained for the profile corresponds to the reference profile. To this end, it is provided with sensors which measure the distances between a reference base of the machine and the surface of the rail which is being ground by a grinding head; when the sensors indicate that the real values of the distances correspond to the reference values memorized in an analyzer, the latter issues an order to a command unit which automatically lifts the grinding head in question into a non-working position.

The automatic grinding operations are performed without difficulties along sections having only rails, without switches. However, when the grinding vehicle arrives in the vicinity of switches, in particular in the frog and in the entrance of the switch blade where the width of the running tread varies, it is necessary to lift the grinding wheels over very specific distances in order to avoid damaging these zones. Similarly, if there are obstacles on the path of the grinding wheels, it is also necessary to lift the grinding wheels in order to avoid the destruction of the latter. This may be the case, in particular if cup grinding wheels are used when the latter pass the guard rails of a switch.

In order to take these problems into account, grinding vehicles are currently equipped either with magnetic sensors or with installations for measuring the path traveled in order to command the lifting of the grinding wheels in the entire zone of a switch. The magnetic sensors mounted on the grinding carriages are actuated by magnets placed beforehand along the track. Lifting of the grinding wheels with the aid of the installations for measuring the path traveled requires programing of the grinding path before work. These two command systems present numerous disadvantages, on the one hand, due to the fact that it is necessary to reserve fairly large safety distances before and after the switch zones, this results in relatively large unground zones and, on the other hand, with the grinding carriages or machines used up until now, all the grinding wheels are lifted or lowered at the same time which also increases the safety distances to be respected. Each variation in the grinding path requires new programing of the measuring installation with the respective displacement of all the magnets.

SUMMARY OF THE INVENTION

An aim of the present invention is to limit the width of the unground zone and to facilitate the preparation of work and the command for lifting the grinding wheels in the critical zones.

The first advantages are a result, first of all, of the fact that the sensors make it possible to automatically recognize and distinguish the blade and the frog and, consequently, to interrupt grinding only in the critical zones of a blade and of a frog when the grinding wheels are lowered and are working between these zones. The length of the unground zone is simultaneously reduced to a minimum. Moreover, the preparation work is eliminated, which work was hitherto necessary either because of the positioning of the magnets or because of the programing of the grinding path.

The terms critical zones are understood to mean firstly the zones where the grinding wheels which are not lifted can damage parts of a switch, for example, the widening of the running tread or the adjacent auxiliary parts of the rails; moreover, these terms are also understood to mean the zones in which obstacles may be found in the path of the grinding wheels and risk damaging them.

Moreover, according to the invention, the command program makes it possible, in the case of a machine with several grinding heads, to easily lift and lower each of the grinding heads successively at a very specific location which is offset with respect to the adjacent one in order to avoid creating pronounced ramps which would be produced if all the grinding wheels began machining at the same place; it is therefore possible to create a perfect continuous junction between the ground and unground zone.

The memorized command program is preferably such that it comprises, for each switch in question, only the data defining the lifting distances for the grinding heads for the two critical zones, namely the blade zone and the frog zone, but not for the intermediate zone between two critical zones where grinding may be performed; it is the actuation of one or more sensors in question which detects the star of the first critical zone and then of the second critical zone of this switch and which triggers the program each time, giving the lifting distance in the zone in question.

The program may also be modified such that, for each type of switch, not only the lengths of the two critical zones where the grinding wheels must be lifted are memorized, but also the length of the intermediate zone, therefore the grinding zone, where the grinding wheels are lowered. In this case, all the program comprising the complete switch is triggered by the sensor or sensors in question when the latter detect the start of the switch; the sensors then remain inactive along the switch since all the lifting and lowering lengths are programed. For this command, the measurement of the path traveled between two critical zones is essential, and the accuracy of the measurements which have to be performed means that this type of command is used preferably for short switches whilst, for long switches, it is preferable to use the first type of program mentioned.

BRIEF DESCRIPTION OF THE DRAWINGS

Preferred embodiments result from the dependent claims.

By way of example, the appended drawings represent embodiments of the invention.

FIG. 9*a* illustrates diagrammatically an example of the dimensions of the facets machined by the peripheral grinding wheels M1 to M4 on a rail.

FIG. 9*b* represents diagrammatically, for the case of grinding with cup grinding wheels, an example of the position of grinding wheels M'5 to M'8 on a rail.

FIG. 10 shows a block diagram of the command device.

DESCRIPTION OF THE PREFERRED EMBODIMENTS

Figure 1:
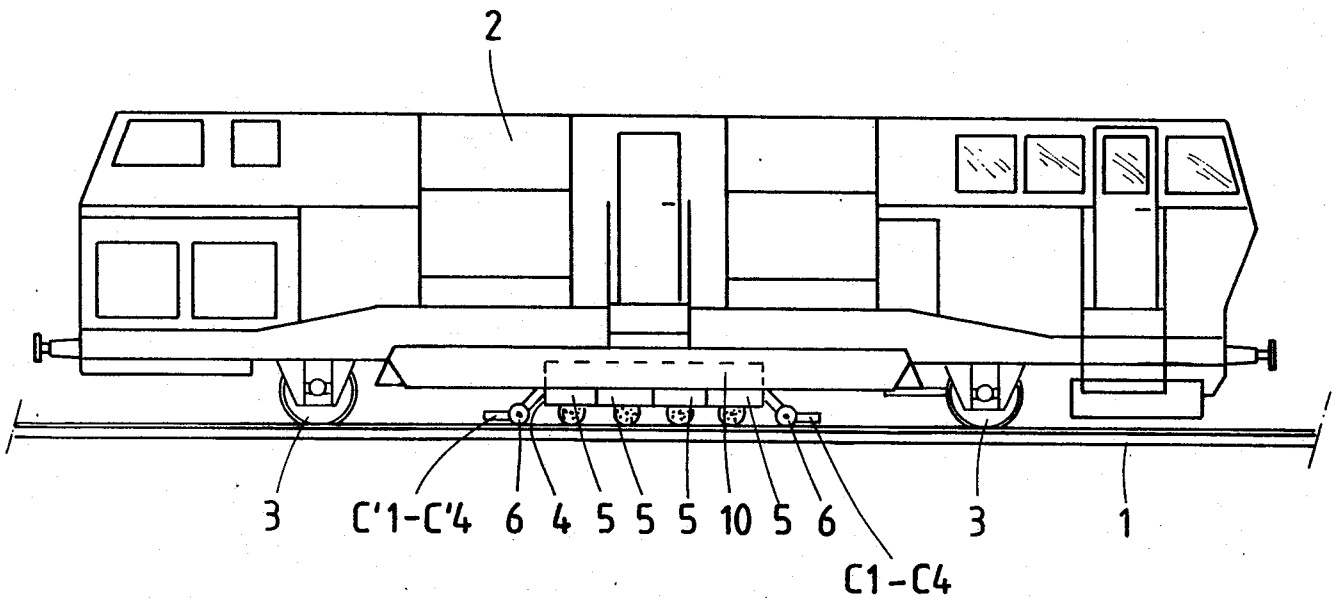
FIG. 1 is a lateral view of a grinding machine with a vehicle according to the invention equipped with a grinding carriage carrying four grinding heads per stretch of rails with peripheral grinding wheels.
Figure 2:
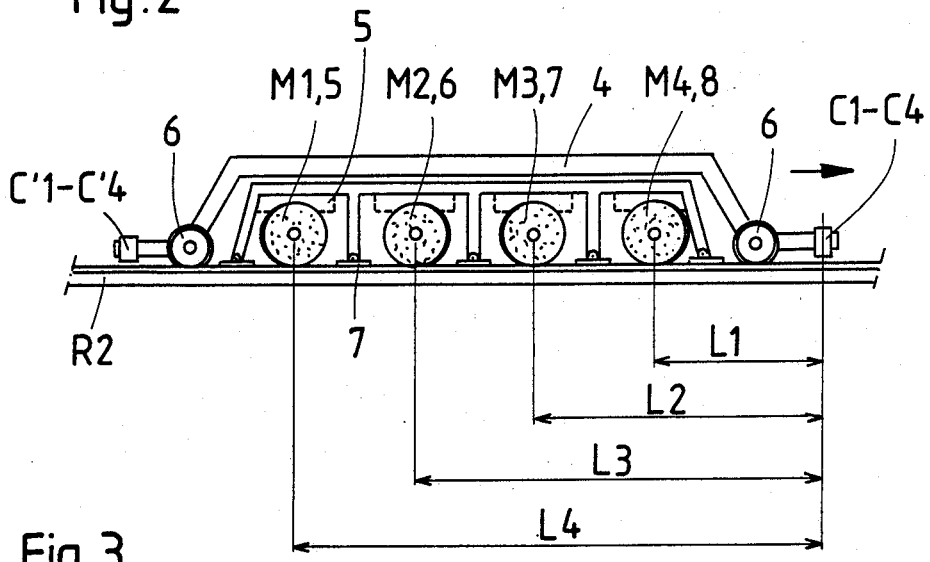
FIG. 2 is a diagrammatic profile view of the grinding carriage according to FIG. 1.
Figure 3:
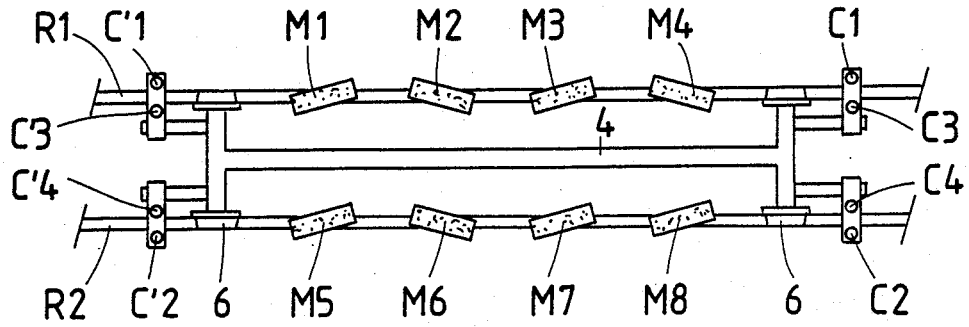
FIG. 3 is view thereof from above.

FIG. 1 diagrammatically represents a grinding machine formed by a single grinding vehicle 2, with two axles 3, which can be displaced on the track 1 and is equipped with a grinding carriage 4 which s equipped with grinding heads 5. This grinding carriage 4 as represented diagrammatically on a larger scale in FIGS. 2 and 3 is supported by two axles 6 and comprises on each stretch of rail R1, R2 four grinding heads 5 each supporting a peripheral grinding wheel M1, M2, M3, M4 and M5, M6, M7, M8, respectively. The grinding heads 5 may be lifted individually by lifting devices 10 (FIG. 1). Shoes 7, which remain in contact with the rail surface during grinding, are provided between the grinding wheels M1 to M4 and M5 to M8, respectively.

Sensors C1 to C4 and C'1 to C'4, respectively, are mounted at each end of the grinding carriage 4. The sensors C1 to C4 operate in forward travel, according to the arrow indicated on FIG. 2, and the sensors C'1 to C'4 operate in reverse travel. The sensors are mounted in pairs, each pair comprising a sensor placed on the outside of the rail C1, C2, C'1, C'2 and a sensor placed on the inside of the rail C3, C4, C'3, C'4. The pairs of sensors are supported by shoes 11 provided in order to slide on the rail surface, as may be seen, for example in FIGS. 4*a*, 4*b*. Instead of being mounted on shoes, they may be mounted directly on the axles 6.

The distances between the front sensors C1 to C4 and the various grinding wheels are called, respectively, L1 for the grinding wheel M4 and M8, respectively, L2 for the grinding wheel M3 and M7, respectively, L3 for the grinding wheel M2 and M6, respectively, and L4 for the grinding wheel M1 and M5, respectively. The corresponding distances between the grinding wheels M1 to M4 and M5 to M8, respectively, and the rear sensors C'1 to C'4 which operate if the vehicle is displaced in reverse travel are not indicated on the figure.

Figure 7:
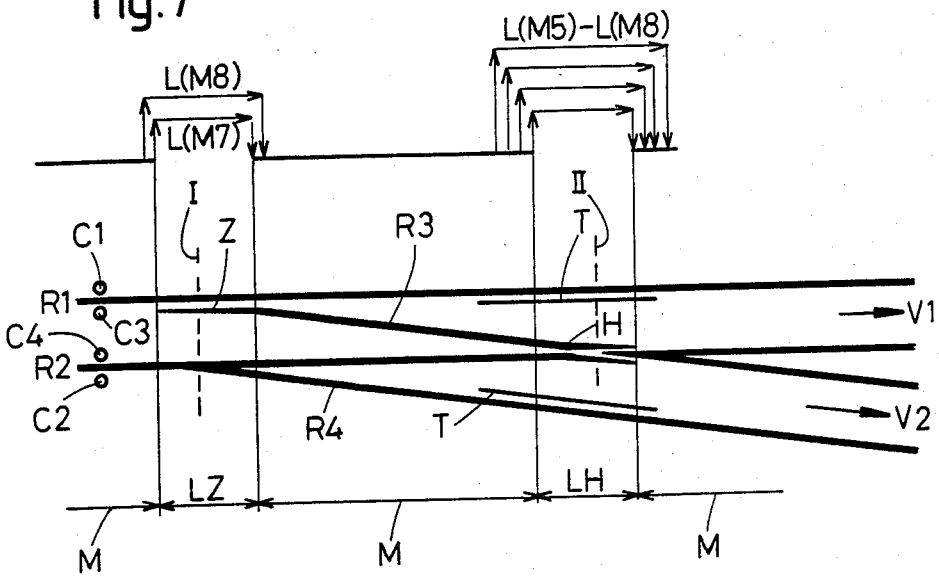
FIG. 7 is a diagrammatic view from above of a switch with the indications of the lifting zones of the different grinding wheels in the case where the straight track V1 is traveled.

For a better explanation of the arrangement and the functions of these sensors, reference is made to FIG. 7 where a switch is shown with an indication of the ground and unground zones and, on the left, the position of the sensors C1 to C4 just before the start of the switch. In this FIG. 7, the rails R1 and R2 of the straight track V1, the blade Z, the rails 3 and R4 of the diverted track V2, the guard rails T and the frog H may be seen. The zones M correspond to the grinding zones, the zone LZ corresponds to the unground zone in the region of the blade L, the zone LH corresponds to the unground zone in the region of the frog H.

Figure 4A:
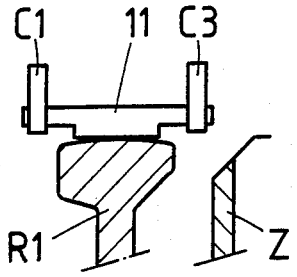
FIGS. 4*a* and 4*b* represent diagrammatically a view in section of the sensors in the critical zone of the blade of the switch for the two stretches of rails at the location I indicted in broken lines in FIG. 7.
Figure 4B:
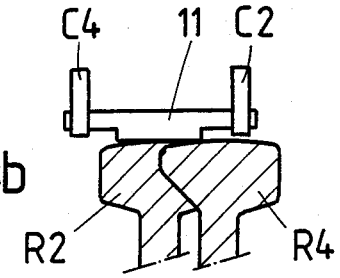

The sensors C1 or C2 and C'1 or C'2, respectively, placed on the outside of the rail detect when they are passing the blade zone LZ, the widening of the running tread in the blade Z, as illustrated in FIGS. 4*a* and 4*b* for the location I indicated in broken lines in FIG. 7 and for the case where the carriage travels along the straight track V1. In these conditions, it is only the sensor C2 (FIG. 4*b*) which is actuated because it detects, on the outer side of the rail R2, the widening of the running tread at the start of the junction of the diverted track with the rail R4. On the other hand, neither the sensor C4 nor the sensors C1 and C3 following the rail R1 (FIG. 4*a*) are actuated because the blade is distant from the rail R1.

When the vehicle travels along the diverted track V2 (FIG. 8), it is only the sensor C1 which is actuated.

In order to detect the frog zone LH, use may be made either of the presence of the inner parts of the frog H or the presence of one of the guard rails T; in both cases, in addition to the outer sensors, the sensors C3, C4 and C'3, C'4, respectively, placed inside the rail are also used.

Figure 5A:
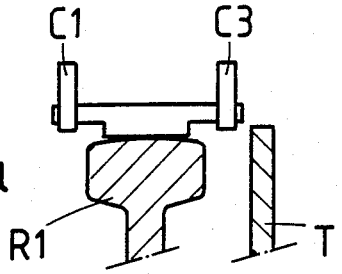
FIGS. 5*a* and 5*b* represent similar views in section in the frog, at the location II indicated in broken lines in FIG. 7.
Figure 5B:
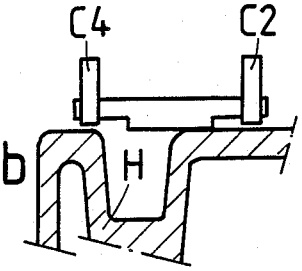

FIGS. 5*a* and 5*b* show the situation at the center of the frog H, at the location II indicated in broken lines in FIG. 7 in the case where the inner parts and the widening of the running tread in the frog H, respectively, are detected on the rail R2 by the two sensors C and C4 which are actuated (FIG. 5*b*). The sensors C1 and C3 on the rail R1 remain inoperative, a illustrated in FIG. 5*a*.

When the vehicle travels along the diverted track V2 (FIG. 8), it is the sensors C1 and C3 which are actuated while the sensors C2, C4 remain inoperative.

Therefore, when the inner parts of the frog H are detected, it is the two sensors C1 and C3 which work together if the diverted track V2 is traveled, whilst it is the two sensors C2 and C4 which work together if the straight track V1 is traveled.

Figure 5C:
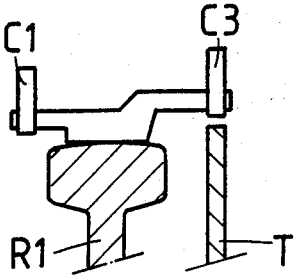
FIG. 5*c* represents a similar view in section of an alternative embodiment in which the guard rail in the frog zone detected.

FIG. 5*c* shows the alternative embodiment for detecting the frog zone H. In this case, the inner sensors, under the circumstances, according to FIG. 5*c*, the sensor C3 on the rail R1, is mounted such that it responds to the presence of the guard rail T and announces, in this manner, the presence of a frog zone H.

Therefore, in this case, the two sensors C1 and C4 are used when passing the diverted track V2 and the two sensors C2, C3 are used when passing the straight track V1.

In this manner, that sensor or those sensors which respond when approaching to a switch define in which direction the switch is traveled: from the blade towards the frog or from the frog towards the blade.

Use is preferably made of known sensors without contacts, for example of the inductive, pneumatic or sonar type which must be capable of detecting the presence of the rail material, that is to say if the distance between the rail material and the sensor is less than a minimum value the sensor will issue a signal. It is also, in principle, possible to use mechanical sensors which enter in contact with the widened surfaces of the rails and with the auxiliary parts, respectively, in the frog and possibly blade zones.

The sensors C1 to C4 and C'1 to C'4 are connected to a computation unit 8, illustrated diagrammatically in FIG. 10 which shows the block diagram of the device. These sensors command the computation unit 8 which also receives a signal corresponding to the path traveled issued by a unit 9 for measuring the path traveled. The computation unit 8 in turn commands all the devices 10 for lifting the grinding heads and for raising or lowering the various grinding wheels M1 to M8 in question. This command takes place according to a program set up for the blade and the frog of each type of switch to be ground during a run.

The computation unit 8 is therefore programed beforehand as a function of the type of switch to be ground. The data are entered in order to define the lifting distances corresponding to the length of the blade and of the frog as a function of the direction of work and this takes place for each grinding-wheel head. In this manner, it is possible to determine which grinding wheels should be lifted over the blades and the frogs and in what sequence they should be lifted. Programing of the computation unit concerning the switches is performed before or during work. The type of switch is entered independently of the direction of travel. When several switches are to be ground, it is necessary only to respect the sequence of the different types. The computation unit 8, in connection with the signals received from the sensors in question, automatically determines in this manner the direction of work either in the direction of the blade toward the frog or vice versa, as a function of the command signals from the sensors outside and inside the rails, as already explained.

The principle of command by means of sensors and of the computation unit 8 consists in that the role of the sensors is only to detect the start of the critical zones and therefore to trigger the program incorporated in the computation unit 8 for the type of switch in question. This program defines, as a function of the signal from the sensor, at which exact moment each grinding head must be individually lifted and at which place it must be lowered again for the grinding work to continue. This means that the sequence of each grinding head, one after the other, is programed as a function of the type of switch and the length of the critical zones. Since the program does not contain memorized length data, it is necessary to enter the distances traveled measured by the unit 9 into the computation unit in order to command the grinding-wheel heads. The path traveled may also be determined indirectly from the speed measured and the time.

Figure 6:
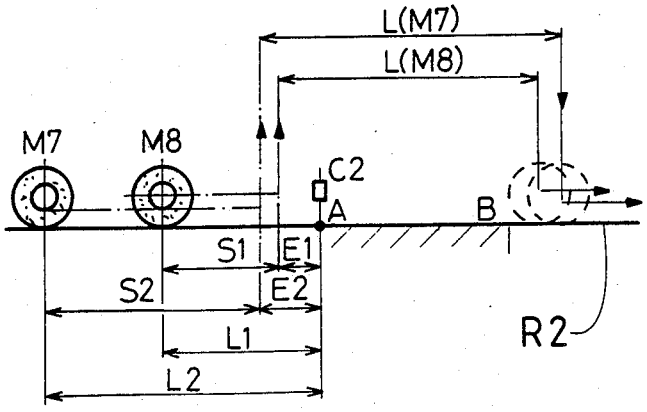
FIG. 6 is a diagram of the principle showing the lifting of two consecutive grinding wheels above a critical zone A–B.

The principle of command of the individual grinding wheels is illustrated diagrammatically in FIG. 6 for, by way of example, command of the two grinding wheels 7 and 8 by the sensor C2. A portion of the track may be seen on which two points A and B located on the rail R2 and defining a critical zone have been defined. At the point A, the sensor C2 detects, for example, the widening of the running path whilst at the point B this same sensor C2 is no longer operative because the width of the rail R2 has returned to normal. When the sensor C2 is actuated at the point A, it commands the computation unit 8, of which the program in question is triggered and which in turn commands the lifting device 10 so that the grinding wheel M8, after the traveled distance S1, and the grinding wheel M7, after the traveled distance S2 are lifted, these grinding wheels then being lowered after the distance L(M8) and L(M7), respectively. Preferably, the distances L(M7) and L(M8) do not have the same value, as illustrated, in order to arrive at a continuous junction between the ground and unground zones and to avoid pronounced ramps which would risk being produced if the lifting or lowering of all the grinding wheels took place at the same point.

The distances S1, S2 determining the location of lifting the grinding wheels after actuation of the sensor C2 are calculated as a function of the distances L1, L2 between the grinding wheels and this sensor and are entered beforehand into the program of the computation unit. The distances S1, S2 are chosen such that the lengths $E1=L1-S1$ and $E2=L2-S2$, respectively, therefore the distances between the place where the sensor responds and the place where the grinding wheel is lifted makes it possible to retain a sufficient safety margin and permits an offsetting of the lifting points. The distances E1, E2 are generally not the same for the two directions of passage over a switch. For this reason, the data E1, E2 which determine S1, S2 generally have different values depending on the directions of the blade toward the frog or the frog toward the blade and, as already mentioned, this direction is detected by the sensors in question so that the correct program is chosen. The distances L(M7) and L(M8) during which the grinding wheels are lifted depend on the type of switch considered and area also programed into the computation unit independently of the direction of travel, retaining the offsetting of the start of grinding for each grinding wheel.

By means of the command described, it is possible to reduce the unground zones to a minimum length. The program also makes it possible, in a frog or a blade zone, to lift only those of the grinding heads which could damage the widenings and other parts of the switch.

Figure 8:
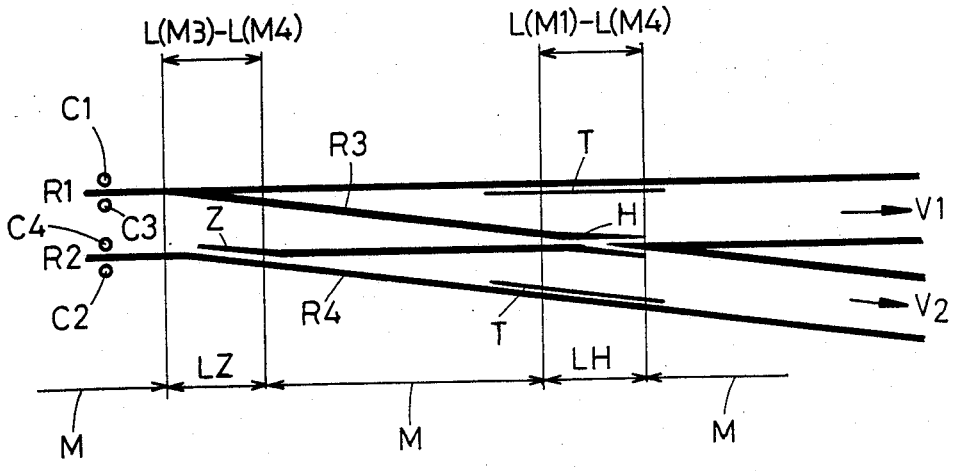
FIG. 8 is a similar view of the switch according to FIG. 7 in the case where the diverted track V2 is traveled.

FIG. 9*a* shows an example of an arrangement of the peripheral grinding wheels, indicating the widths of the facets machined by the grinding wheels M1 to M4 on the rail R1. It has been assumed that the grinding wheels M3 and M4 grind only the outer faces of the rails whilst the grinding wheel M2 grinds the central running tread of the rails and that the grinding wheel M1 grinds the inner face. FIGS. 7 and 8 illustrate and example of the way in which the different grinding wheels are commanded assuming that the grinding wheels are distributed as explained in connection with FIG. 9*a* and also assuming that the grinding wheels M7, M8 grind the outer faces of the rails, the grinding wheel M6 grinds the running tread and the grinding wheel M5 grinds the inner face. During grinding of a switch, as illustrated in FIGS. 7 and 8, the grinding vehicle must perform two runs, one for grinding the straight track V1 (FIG. 7), the other for grinding the diverted track V2 (FIG. 8). Before crossing the switch with the vehicle, it is necessary to enter into the computation unit the type of switch to be ground. All the other commands are then executed automatically and independently of the direction of travel.

In the example according to FIGS. 7 and 8, it has been assumed that the types of grinding wheel used, therefore peripheral grinding wheels, are such that the blade Z, in its position which is distant from the rail, as well as the guard rails T in the zone of the frog H, are outside the alignment of all the grinding wheels and are not touched.

This is why, in the straight track V1, illustrated in FIG. 7, the sensors C1 and C3 remain inactive on the rail R1 throughout the run and this rail R1 is therefore completely ground by the grinding wheels M1 to M4 which are not lifted.

On the rail R2, in the blade zone LZ, if the straight track V1 is traveled, the outer sensor C2 is actuated (FIG. 4*b*) and commands the computation unit 8 in order to raise the outer grinding wheels M7 and M8 over the distances L(M7) and L(M8), respectively, after which they are lowered in order to grind the zone M. In the frog zone LH, the sensors C2 and C4 are actuated (FIG. 5*b*) and command the lifting of all the grinding wheels M5 to M8 over the distances L(M5) to L(M8), respectively. As indicated diagrammatically in FIG. 7, the lifting and the lowering of the grinding wheels is performed successively and in an offset manner in order to obtain a continuous and perfect junction between the ground zones M and the unground zones LZ and LH.

In the diverted track V2, illustrated in FIG. 8, the sensors C2 and C4 remain inoperative and the rail R4 is therefore completely ground by the grinding wheels M5 to M8. On the other hand, the sensor C1 is actuated on the rail R3 in the blade zone LZ, and it is only the outer grinding wheels M3 and M4 which are lifted. In the frog zone LH the two sensors C1 and C3 are actuated and therefore command the lifting of all the grinding wheels M1 to M4. Of course, the different grinding wheels are lifted and lowered again successively and in an offset manner, although this is not illustrated in FIG. 8 for reasons of simplicity.

According to the invention, provision is also made for incorporating in the program the lengths of the possible places where there are obstacles to the free passage of one or more grinding wheels in a working position such that the latter are lifted in order to avoid damage thereto.

Therefore, in the case of using peripheral grinding wheels as was the case in the embodiment which has just been describe in detail, such obstacles do not generally exist, on the other hand, in the case of using cup grinding wheels, these obstacles may exist. FIG. 9*b* shows diagrammatically the distribution off four cup grinding wheels M'5 to M'8 on a rail, the grinding wheels M7 and M'8 grind the outer faces of the rail whilst the grinding wheel M'6 grinds the central running tread and the grinding wheel M'5 grinds the inner face. With reference to FIGS. 5*a* or 5*c*, it is easy to imagine that the guard rail T may constitute an obstacle for the cup grinding wheels and, in this case, it is necessary to provide, in addition, for lifting of the grinding wheels in question during passage over the zone having a guard rail. The blades in their positions which are distant from the rail also form an obstacle of this type for the cup grinding wheels.

In the example in question, the command program was such that the sensors in question triggered the program at the start of each critical zone of a switch. This program therefore contained only the memorized lifting distances. As mentioned in the introduction, it is also possible in principle to provide a program in which the complete switch is memorized, comprising the two lifting zones and the intermediate lower zone, in this case the complete program for a switch is triggered when the sensor in question detects the start of this switch.

In principle, the invention also applies to the case where use is made of a single grinding head with a single grinding wheel whose direction of work is modified during several passages in order to obtain complete grinding. However, the grinding machine generally comprises several grinding heads which may also be distributed on two or more grinding carriages or even comprise two or more coupled grinding vehicles In every case, it is sufficient to provide two sensors per stretch of rail at the start of the machine and of the first grinding vehicle, respectively, and two sensors per stretch of rail at the end, and the individual command of all the grinding wheels of the different carriages or vehicles is performed via the program triggered by the sensors. In the case where all the grinding wheels belonging to a carriage have to be lifted in a critical zone, it is also possible to provide a command which lifts and lowers the entire carriage with all the grinding wheels.

The invention is not limited to the example described but many alternative embodiments could be envisaged, above all with regard to the type of sensors.

I claim:

1. A grinding machine for reprofiling railheads equipped with at least one grinding head (5) per stretch of rail which may be moved with respect to height by at least one lifting device (10) which may be commanded automatically, wherein it is equipped with an installation for automatically lifting the grinding wheels in the critical zones of the switches, zones of the blade (Z) and of the frog (H), comprising at least two sensors (C1, C;; C2, C4), per stretch of rail (R1, R2), installed before all the grinding heads (5), in the direction of travel, a sensor (C1, C2) on the outside, the other (C3, C4) on the inside of the rail (R1, R2) and which are capable of detecting the widening of the running tread in the zone of a switch and/or their auxiliary parts adjacent to the rails, and of issuing a signal in this case;

a computation unit (8) whose inputs are connected to the sensors (C1 to C4) and whose outputs are connected to each lifting device (10), and which is equipped with a memory in which all the data defining the lifting distances of each grinding head in the critical zones of the type or of the various types of switch in question, in their order of sequence, are memorized, thereby representing a program for commanding the grinding heads;

a unit (9) for measuring the path traveled connected to the sensors (C1 to C4) and to the computation unit (8), this computation unit(8) being arranged in order to command the lifting and the lowering of each grinding head (5) independently of the others over distances which are predetermined according to the type of switch in question as a function of the signals of various sensors, of the memorized data as well as of the path traveled.

2. The machine as claimed in claim 1, wherein two pairs of sensors (C1, C3; C'1, C'3; C2, C4; C'2, C'4) are provided per stretch of rail (R1, R2) and which are fixed at the front and at the rear of the assembly of grinding heads (5), one pair operating in forward travel and one pair operating in reverse travel.

3. The machine as claimed in claim 2, wherein the outer sensors (C1, C2; C'1, C'2) are capable of detecting the widening of the running tread in the blade and in th frog.

4. The machine as claimed in claim 2, wherein the inner sensors (C3, C4; C'3, C'4) are capable of detecting the inner parts of the frog (H).

5. The machine as claimed in claim 2, wherein the inner sensors (C3, C4; C'3, C'4) are capable of detecting the guard rails (T).

6. The machine as claimed in claim 1, wherein the sensors are inductive sensors.

7. The machine as claimed in claim 1, wherein the sensors are sonar sensors.

8. The machine as claimed in claim 1, wherein the sensors are pneumatic sensors.

9. The machine as claimed in claim 1 having several grinding heads, wherein the command program provides the lifting and the lowering of the grinding heads in question in a successive and offset manner.

10. The machine as claimed in claim 9, wherein the command program also comprises data defining the distance of the grinding zone of each grinding head between two critical zones of a switch.

* * * * *